US011211003B2

(12) United States Patent
Seo et al.

(10) Patent No.: US 11,211,003 B2
(45) Date of Patent: Dec. 28, 2021

(54) DISPLAY DEVICE HAVING AT LEAST TWO EMISSION ENABLE PERIODS PER IMAGE FRAME AND METHOD OF DRIVING THE SAME

(71) Applicant: SAMSUNG DISPLAY CO., LTD., Yongin-si (KR)

(72) Inventors: Young Wan Seo, Yongin-si (KR); Min Kyu Woo, Yongin-si (KR); An Su Lee, Yongin-si (KR); Cheol Gon Lee, Yongin-si (KR)

(73) Assignee: SAMSUNG DISPLAY CO., LTD., Yongin-si (KR)

( * ) Notice: Subject to any disclaimer, the term of this patent is extended or adjusted under 35 U.S.C. 154(b) by 0 days.

(21) Appl. No.: 16/524,744

(22) Filed: Jul. 29, 2019

(65) Prior Publication Data

US 2020/0090587 A1 Mar. 19, 2020

(30) Foreign Application Priority Data

Sep. 17, 2018 (KR) ..... 10-2018-0111052

(51) Int. Cl.

| | |
|---|---|
| ***G09G 3/30*** | (2006.01) |
| ***G09G 3/3241*** | (2016.01) |
| ***G09G 3/3291*** | (2016.01) |
| *G09G 3/36* | (2006.01) |

(52) U.S. Cl.

CPC ..... *G09G 3/3241* (2013.01); *G09G 3/3291* (2013.01); *G09G 3/3648* (2013.01); *G09G 2300/0866* (2013.01)

(58) Field of Classification Search

CPC ..... G06G 2320/00–06; G06G 2300/04–0895; G06G 3/12; G06G 3/30–3291

See application file for complete search history.

(56) References Cited

U.S. PATENT DOCUMENTS

| | | | | |
|---|---|---|---|---|
| 8,427,515 | B2 | 4/2013 | Kim et al. | |
| 9,064,458 | B2 | 6/2015 | Lee | |
| 9,236,009 | B2 | 1/2016 | Park et al. | |
| 9,269,292 | B2 | 2/2016 | Koh | |
| 2017/0125502 | A1* | 5/2017 | Ota | H01L 27/3272 |
| 2017/0186374 | A1* | 6/2017 | Kim | G09G 3/3233 |
| 2018/0151132 | A1* | 5/2018 | Lee | G09G 3/30 |
| 2018/0204510 | A1* | 7/2018 | Chung | G09G 3/3233 |

FOREIGN PATENT DOCUMENTS

| | | |
|---|---|---|
| KR | 10-1122894 | 2/2012 |
| KR | 10-2012-0028426 | 3/2012 |
| KR | 10-2013-0112178 | 10/2013 |
| KR | 10-1350398 | 1/2014 |

* cited by examiner

*Primary Examiner* — Sanghyuk Park

(74) *Attorney, Agent, or Firm* — F. Chau & Associates, LLC

(57) ABSTRACT

In a display device including pixels, each of the pixels may include: a first transistor coupled to a first node, a first power supply voltage line, and a second node; and a light-emitting diode coupled to the second node and a second power supply voltage line. Each image frame may include at least two emission enable periods for the light-emitting diode, and at least one emission inhibit period between the at least two emission enable periods.

23 Claims, 10 Drawing Sheets

DISPLAY DEVICE HAVING AT LEAST TWO EMISSION ENABLE PERIODS PER IMAGE FRAME AND METHOD OF DRIVING THE SAME

CROSS-REFERENCE TO RELATED APPLICATION

The present application claims priority under 35 U.S.C. § 119 to Korean Patent Application No. 10-2018-0111052, filed on Sep. 17, 2018 in the Korean Intellectual Property Office, the disclosure of which is incorporated by reference herein in its entirety.

TECHNICAL FIELD

Exemplary embodiments of the inventive concept relate to a display device having at least two emission enable periods per image frame and a method of driving the same.

DISCUSSION OF RELATED ART

Due to the growing importance of display devices as a connection medium between users and information, the use of various display devices, such as liquid crystal display devices, organic light-emitting display devices, and plasma display devices, has increased.

An organic light-emitting display device may display an image using light-emitting diodes which generate light by recoupling of electrons and holes, and may be driven at a high response speed with low power consumption.

To allow the light-emitting diodes to emit light at a desired gradation, each pixel may adjust the amount of driving current to be supplied to a corresponding light-emitting diode.

However, as resolution of display devices increases, the amount of driving current that can be supplied to each light-emitting diode is limited, which may result in a defective display.

SUMMARY

According to an exemplary embodiment of the inventive concept, in a display device including pixels, each of the pixels may include: a first transistor including a gate electrode coupled to a first node, a first electrode coupled to a first power supply voltage line, and a second electrode coupled to a second node; and a light-emitting diode including an anode electrode coupled to the second node, and a cathode electrode coupled to a second power supply voltage line. Each of image frames may include at least two emission enable periods for the light-emitting diode, and at least one emission inhibit period between the at least two emission enable periods.

In an exemplary embodiment of the inventive concept, the display device may further include: a second transistor including a gate electrode coupled to a scan line, a first electrode coupled to the first node, and a second electrode coupled to a third node; a first capacitor including a first electrode coupled to the first node, and a second electrode coupled to a first control line; a third transistor including a gate electrode coupled to a second control line, a first electrode coupled to the third node, and a second electrode coupled to the second node; and a second capacitor including a first electrode coupled to the third node, and a second electrode coupled to a data line.

In an exemplary embodiment of the inventive concept, during each of the at least two emission enable periods, a first power supply voltage applied to the first power supply voltage line may be greater than a second power supply voltage applied to the second power supply voltage line.

In an exemplary embodiment of the inventive concept, the first power supply voltage in each of the at least two emission enable periods may be greater than the first power supply voltage in the emission inhibit period.

In an exemplary embodiment of the inventive concept, the second power supply voltage in each of the at least two emission enable periods may be less than the second power supply voltage in the at least one emission inhibit period.

In an exemplary embodiment of the inventive concept, a first control voltage applied to the first control line during each of the at least two emission enable periods may be less than the first control voltage in the at least one emission inhibit period.

In an exemplary embodiment of the inventive concept, a first control voltage applied to the first control line during a first initialization period may be less than the first control voltage in each of the at least two emission enable periods.

In an exemplary embodiment of the inventive concept, during at least a portion of the first initialization period, a second control voltage applied to the second control line may be at a turn-on level, and a scan signal applied to the scan line may be at a turn-on level.

In an exemplary embodiment of the inventive concept, during a compensation period, the second control voltage and the scan signal may be at turn-on levels, and the first power supply voltage in the compensation period may be greater than the first power supply voltage in the first initialization period.

In an exemplary embodiment of the inventive concept, during at least a portion of the first initialization period, the second control voltage may be at a turn-off level, the scan signal may be at the turn-on level, the first power supply voltage may be less than or equal to the second power supply voltage.

In an exemplary embodiment of the inventive concept, the first control voltage in a second initialization period may be less than the first control voltage in each of the at least two emission enable periods. The first power supply voltage in the second initialization period may be less than or equal to the second power supply voltage.

In an exemplary embodiment of the inventive concept, each of the image frames may sequentially include the first initialization period, the compensation period, the data write period, the second initialization period, and the at least two emission enable periods.

According to an exemplary embodiment of the inventive concept, in a method of driving a display device including pixels, each of the pixels including a driving current path including a first power supply voltage line, a first electrode and a second electrode of a first transistor, an anode electrode and a cathode electrode of a light-emitting diode, and a second power supply voltage line, the method includes: writing, in a data voltage write operation, a data voltage to a first electrode of a first capacitor coupled to a gate electrode of the first transistor, where a first power supply voltage applied to the first power supply voltage line is less than or equal to a second power supply voltage applied to the second power supply voltage line; setting, in a first emission enable operation of the light-emitting diode, the first power supply voltage to be greater than the second power supply voltage; setting, in a emission inhibit operation of the light-emitting diode, the first power supply voltage to be less than or equal to the second power supply voltage; and setting, in a second emission enable operation of the light-emitting diode, the first power supply voltage to be greater than the second power supply voltage. In each of image frames, the data voltage write operation, the first emission enable operation, the emission inhibit operation, and the second emission enable operation may be sequentially performed.

In an exemplary embodiment of the inventive concept, the first power supply voltage in the first emission enable operation and the second emission enable operation may be greater than the first power supply voltage in the emission inhibit operation.

In an exemplary embodiment of the inventive concept, the second power supply voltage in the first emission enable operation and the second emission enable operation may be less than the second power supply voltage in the emission inhibit operation.

In an exemplary embodiment of the inventive concept, the method may further include applying, in a first initialization operation, a first control voltage to a first control line coupled to a second electrode of the first capacitor. The first control voltage in the first initialization operation may be less than the first control voltage in the first emission enable operation and the second emission enable operation.

In an exemplary embodiment of the inventive concept, the method may further include diode-connecting, in a compensation operation, the first transistor. The first power supply voltage in the compensation operation may be greater than the first power supply voltage in the first initialization operation.

In an exemplary embodiment of the inventive concept, the method may further include setting, in a second initialization operation, the first control voltage to be less than the first control voltage in the first emission enable operation and the second emission enable operation. The first power supply voltage in the second initialization operation may be less than or equal to the second power supply voltage.

In an exemplary embodiment of the inventive concept, in each of the image frames, the first initialization operation, the compensation operation, the data voltage write operation, the second initialization operation, the first emission enable operation, the emission inhibit operation, and the second emission enable operation may be sequentially performed.

According to an exemplary embodiment of the inventive concept, in a method of driving a display device including pixels, each of the pixels including a driving current path including a first power supply voltage line, a first electrode and a second electrode of a first transistor, an anode electrode and a cathode electrode of a light-emitting diode, and a second power supply voltage line, the method includes: writing, in a data voltage write operation, a data voltage to a first electrode of a first capacitor coupled to a gate electrode of the first transistor, where a first power supply voltage applied to the first power supply voltage line is less than or equal to a second power supply voltage applied to the second power supply voltage line; applying, in a first emission enable operation of the light-emitting diode, a first control voltage to a first control line coupled to a second electrode of the first capacitor, and setting the first power supply voltage to be greater than the second power supply voltage; setting, in an emission inhibit operation of the light-emitting diode, the first control voltage to be greater than the first control voltage in the first emission enable operation; and setting, in a second emission enable operation of the light-emitting diode, the first control voltage to be less than the first control voltage of the emission inhibit operation, and the first power supply voltage to be greater than the second power supply voltage. In each of image frames, the data voltage write operation, the first emission enable operation, the emission inhibit operation, and the second emission enable operation may be sequentially performed.

In an exemplary embodiment of the inventive concept, the method may further include setting, in a first initialization operation, the first control voltage to be less than the first control voltage in the first emission enable operation and the second emission enable operation, and applying the first control voltage to the first control line.

According to an exemplary embodiment of the inventive concept, in a display device including pixels, each of the pixels includes: a first transistor including a gate electrode coupled to a first node, a first electrode coupled to a first power supply voltage line, and a second electrode coupled to a second node; a first capacitor including a first electrode coupled to the first node, and a second electrode coupled to a first control line; and a light-emitting diode including an anode electrode coupled to the second node, and a cathode electrode coupled to a second power supply voltage line. In each of image frames, a data voltage write operation, a first emission enable operation, an emission inhibit operation, and a second emission enable operation are sequentially performed. During at least the first emission enable operation and the second emission enable operation, a first control voltage is applied to the first control line to turn on the first transistor. During the first emission enable operation and the second emission enable operation, the first power supply voltage is greater than the second power supply voltage, and during the emission inhibit operation, the first power supply voltage is less than or equal to the second power supply voltage.

In an exemplary embodiment of the inventive concept, one of the first power voltage and the second power voltage is maintained at a constant level during the first emission enable operation, the emission inhibit operation, and the second emission enable operation.

In an exemplary embodiment of the inventive concept, the display device further includes: a second transistor including a gate electrode coupled to a scan line, a first electrode coupled to the first node, and a second electrode coupled to a third node; a third transistor including a gate electrode coupled to a second control line, a first electrode coupled to the third node, and a second electrode coupled to the second node; and a second capacitor including a first electrode coupled to the third node, and a second electrode coupled to a data line.

In an exemplary embodiment of the inventive concept, during the data voltage write operation, a first node voltage applied to the first node is calculated according to the following equation: VN1=ELVDDh+Vth+a*DD, and VN1 is the first node voltage, Vth is a threshold voltage of the first transistor, a is a capacitance ratio, and DD is a difference voltage between the data voltage and a reference voltage.

In an exemplary embodiment of the inventive concept, the capacitance ratio is calculated according to the following equation:

$$a = \frac{CprF}{CstF + CprF},$$

and CstF is a capacitance of the first capacitor, and CprF is a capacitance of the second capacitor.

In an exemplary embodiment of the inventive concept, the difference voltage is calculated according to the following equation: DD=Dij−Vsus, and Dij is the data voltage and Vsus is a reference voltage applied to the data line.

BRIEF DESCRIPTION OF THE DRAWINGS

The above and other aspects and features of the inventive concept will become more apparent by describing in detail exemplary embodiments thereof with reference to the attached drawings.

DETAILED DESCRIPTION OF THE EMBODIMENTS

Figure 1:
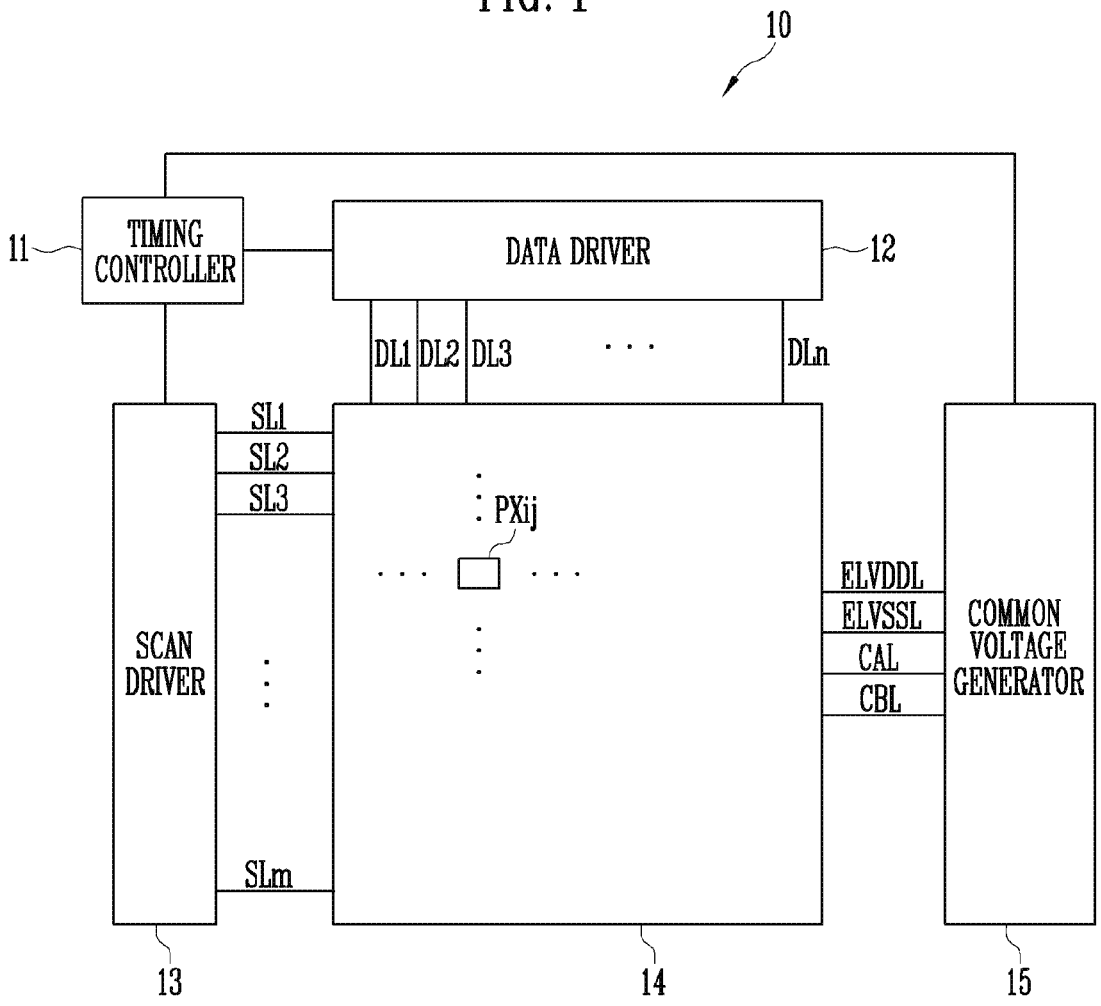
FIG. 1 is a diagram illustrating a display device in accordance with an exemplary embodiment of the inventive concept.

Exemplary embodiments of the inventive concept are directed to a display device and a method of driving the display device capable of securing a sufficient amount of driving current even if the display device has a high resolution.

Hereinafter, exemplary embodiments will be described in greater detail with reference to the accompanying drawings. Like reference numerals may refer to like elements throughout this application.

It is also noted that in this specification, "connected/coupled" refers to one component not only directly coupling another component but also indirectly coupling another component through an intermediate component. On the other hand, "directly connected/directly coupled" refers to one component directly coupling another component without an intermediate component.

FIG. 1 is a diagram illustrating a display device in accordance with an exemplary embodiment of the inventive concept.

Referring to FIG. 1, a display device 10 in accordance with an exemplary embodiment of the inventive concept may include a timing controller 11, a data driver 12, a scan driver 13, a pixel unit 14, and a common voltage generator 15.

The timing controller 11 may generate a clock signal, a scan start signal, etc. corresponding to specifications of the scan driver 13 based on received control signals, and provide the clock signal, the scan start signal, etc. to the scan driver 13. The timing controller 11 may provide, to the data driver 12, gradation values and control signals that are modified or maintained to correspond to specifications of the data driver 12 based on received gradation values and control signals.

The data driver 12 may generate data voltages to be provided to data lines DL1, DL2, DL3, . . . , DLn using the gradation values and the control signals that are received from the timing controller 11. Here, n is a natural number. For example, data voltages generated on a pixel row basis may be substantially simultaneously applied to the data lines DL1 to DLn.

The scan driver 13 may receive control signals such as the clock signal and the scan start signal from the timing controller 11, and generate scan signals to be provided to scan lines SL1, SL2, SL3, . . . , SLm. Here, m is a natural number. The scan driver 13 may provide the scan signals through the scan lines SL1 to SLm and thus select pixels to which data voltages are to be written. For example, the scan driver 13 may sequentially provide scan signals having a turn-on level to the scan lines SL1 to SLm and thus select each pixel row to which data voltages are to be written. The scan driver 13 may be configured in the form of a shift register, and may generate the scan signals in such a way that the scan start signal is sequentially transmitted to a subsequent stage circuit under control of the clock signal. Alternatively, the stage circuits of the scan driver 13 may substantially simultaneously provide scan signals having a turn-on level to the corresponding scan lines in response to a global control signal.

The pixel unit 14 includes pixels. Each pixel PXij may be coupled with a corresponding data line and a corresponding scan line. For instance, if data voltages for one pixel row are applied from the data driver 12 to the data lines DL1 to DLn, the data voltages may be written to a pixel row corresponding to a scan line that has received a scan signal having a turn-on level from the scan driver 13.

The common voltage generator 15 may generate common voltages to be applied in common to the pixels of the pixel unit 14. The common voltages may include a first power supply voltage, a second power supply voltage, a first control voltage, and a second control voltage. The first power supply voltage may be applied to a first power supply voltage line ELVDDL. The second power supply voltage may be applied to a second power supply voltage line ELVSSL. The first control voltage may be applied to a first control line CAL. The second control voltage may be applied to a second control line CBL.

The common voltage generator 15 may be embodied in various forms. For example, the common voltage generator 15 may be embodied in such a way that it is partially or fully integrated with the data driver 12. For example, the first power supply voltage and the second power supply voltage may be generated from the common voltage generator 15 which has the form of a DC-DC converter. The first control voltage and the second control voltage may be generated from the data driver 12.

Alternatively, the common voltage generator 15 may be embodied in such a way that it is partially or fully integrated with the timing controller 11. For example, the first power supply voltage and the second power supply voltage may be generated from the common voltage generator 15 which has the form of a DC-DC converter. The first control voltage and the second control voltage may be generated from the timing controller 11.

As a further alternative, the common voltage generator 15 may be embodied in such a way that it is partially or fully integrated with the timing controller 11 and the data driver 12. For example, the first power supply voltage and the second power supply voltage may be generated from the common voltage generator 15 which has the form of a DC-DC converter. The first control voltage having a relatively large load may be generated from the data driver 12. The second control voltage having a relatively small load may be generated from the timing controller 11.

Figure 2:
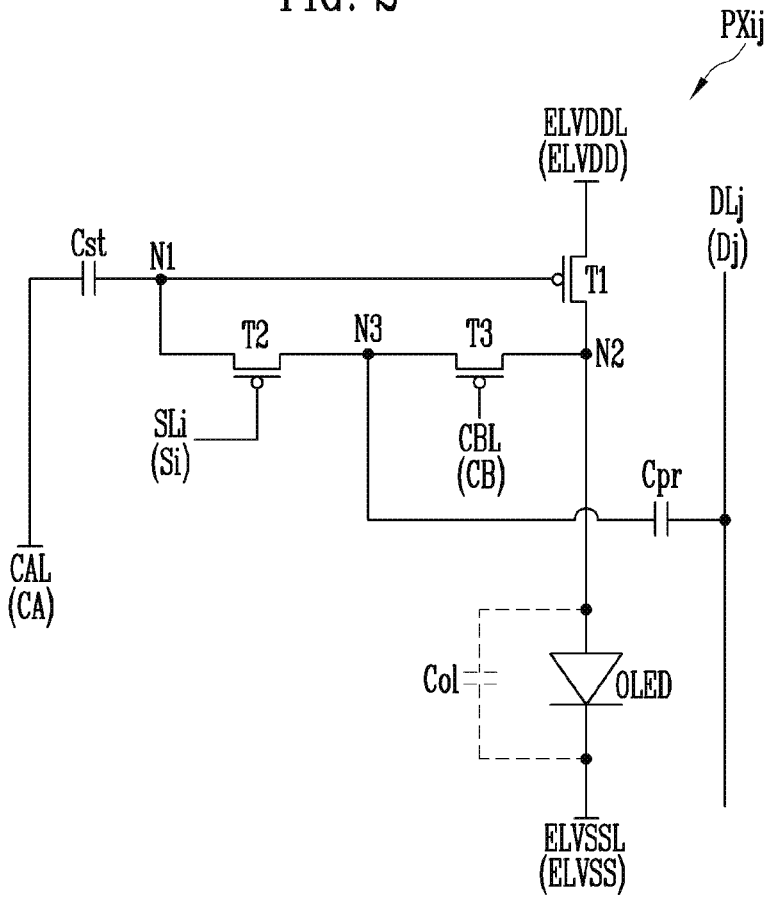
FIG. 2 is a circuit diagram illustrating a pixel in accordance with an exemplary embodiment of the inventive concept.

FIG. 2 is a diagram illustrating a pixel in accordance with an exemplary embodiment of the inventive concept.

Referring to FIG. 2, the pixel PXij in accordance with an exemplary embodiment of the inventive concept may include first to third transistors T1, T2, and T3, first and second capacitors Cst and Cpr, and a light-emitting diode OLED.

It is assumed that the pixel PXij is coupled with an i-th scan line SLi and a j-th data line DLj. Here, i and j are natural numbers.

In the present exemplary embodiment, each of the transistors T1, T2, and T3 has been illustrated as a P-type transistor. Therefore, hereinafter, for the sake of explanation, it will be assumed that, when the level of a voltage applied to a gate electrode of a transistor is a low level, it refers to a turn-on level, and when the level of the voltage is a high level, it refers to a turn-off level.

At least some of the transistors T1, T2, and T3 may be changed to N-type transistors in the present exemplary embodiment. A P-type transistor may be a transistor which is turned on when a gate-source voltage is less than a threshold voltage (a negative number). An N-type transistor may be a transistor which is turned on when a gate-source voltage exceeds a threshold voltage (a positive number).

The first transistor T1 may include a gate electrode coupled to a first node N1, a first electrode coupled to the first power supply voltage line ELVDDL, and a second electrode coupled to a second node N2. The first transistor T1 may be referred to as a driving transistor.

The second transistor T2 may include a gate electrode coupled to the i-th scan line SLi, a first electrode coupled to the first node N1, and a second electrode coupled to a third node N3. The second transistor T2 may be referred to as a switching transistor, a scan transistor, or the like.

The third transistor T3 may include a gate electrode coupled to a second control line CBL, a first electrode coupled to the third node N3, and a second electrode coupled to the second node N2. The third transistor T3 may be referred to as an initialization transistor.

The first capacitor Cst may include a first electrode coupled to the first node N1, and a second electrode coupled to the first control line CAL. The first capacitor Cst may be referred to as a storage capacitor.

The second capacitor Cpr may include a first electrode coupled to the third node N3, and a second electrode coupled to the j-th data line DLj.

The light-emitting diode OLED may include an anode electrode coupled to the second node N2, and a cathode electrode coupled to the second power supply voltage line ELVSSL. Although a difference in voltage between the anode electrode and the cathode electrode is required to be a predetermined level or more to allow the light-emitting diode OLED to emit light, the voltage of the anode electrode may not be rapidly changed because each of the anode electrode and the cathode electrode acts as a kind of capacitor. Therefore, to more clearly describe a light-emitting time of the light-emitting diode OLED, a capacitance Col of the light-emitting diode OLED is illustrated. The light-emitting diode OLED may be an organic light-emitting diode or an inorganic light-emitting diode.

A first power supply voltage ELVDD may be applied to the first power supply voltage line ELVDDL, a second power supply voltage ELVSS may be applied to the second power supply voltage line ELVSSL, a first control voltage CA may be applied to the first control voltage line CAL, a second control voltage CB may be applied to the second control voltage line CBL, an i-th scan signal Si may be applied to the i-th scan line SLi, and a j-th data voltage Dj may be applied to the j-th data line DLj.

A driving current path may include the first power supply voltage line ELVDDL, the first electrode and the second electrode of the first transistor T1, the anode electrode and the cathode electrode of the light-emitting diode OLED, and the second power supply voltage line ELVSSL. As driving current having a predetermined level or more flows through the driving current path, the capacitance Col of the light-emitting diode OLED is charged so that the light-emitting diode OLED may emit light.

However, as described above, since the amount of driving current allowed to be supplied to the light-emitting diode OLED is limited in the display device 10 having a high resolution, defective display may occur. Particularly, under conditions of low-gradation display in which driving current is very low, defective display may more frequently occur. Therefore, a driving method capable of increasing the amount of driving current may reduce the occurrence of a defective display.

Figure 3:
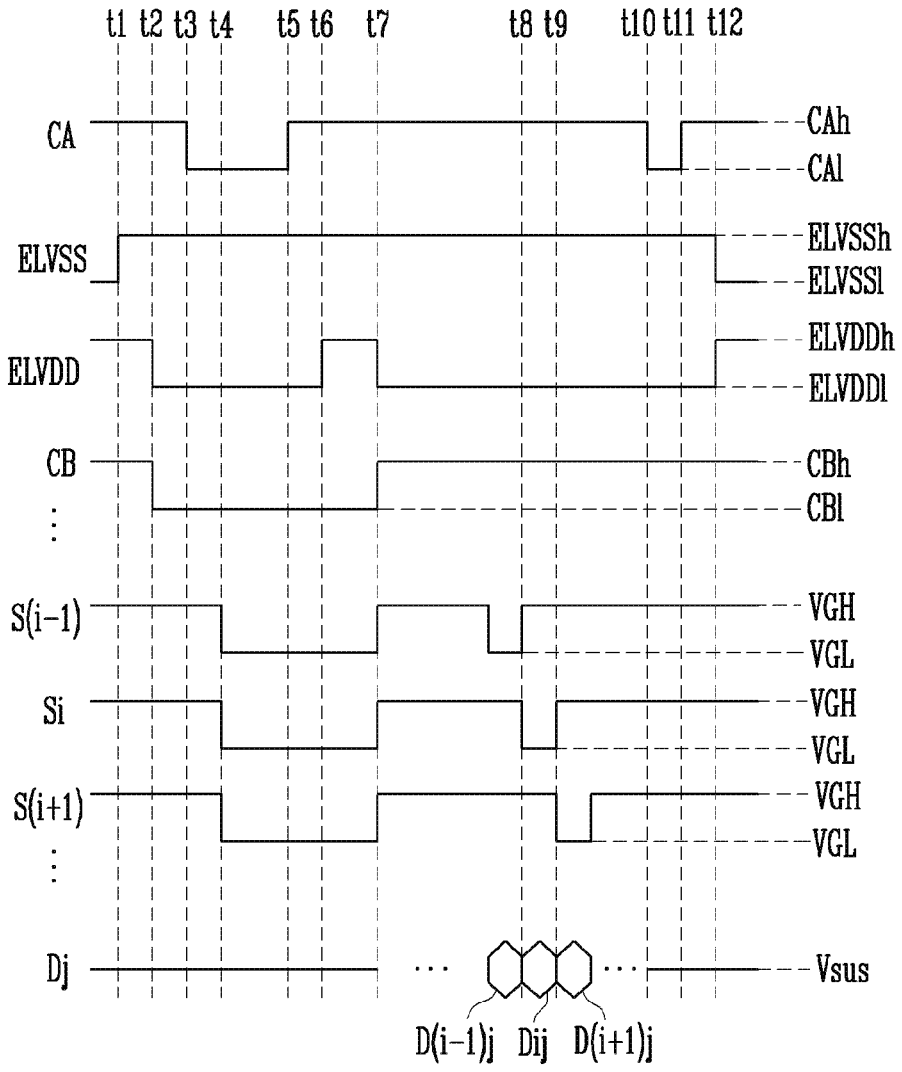
FIG. 3 is a timing diagram for describing a method of driving the display device of FIG. 1 in accordance with exemplary embodiments of the inventive concept.

FIG. 3 is a timing diagram for describing a method of driving the display device of FIG. 1 in accordance with exemplary embodiments of the inventive concept. FIGS. 4 to 8 are circuit diagrams for describing the method of driving the display device according to the timing diagram of FIG. 3 in accordance with exemplary embodiments of the inventive concept.

At time t1, as a previous image frame is terminated, the second power supply voltage ELVSS is increased from a low level ELVSS1 to a high level ELVSSh. Here, the first power supply voltage ELVDD may maintain a high level ELVDDh. For example, the high level ELVDDh of the first power supply voltage ELVDD and the high level ELVSSh of the second power supply voltage EVLSS may be identical to each other. Therefore, a difference in voltage between the anode electrode and the cathode electrode of the light-emitting diode OLED may not be sufficient, whereby light emitting of the light-emitting diode OLED according to the gradation of the previous frame is terminated.

At time t2, the first power supply voltage ELVDD is reduced from the high level ELVDDh to a low level ELVDDl. Thus, a reversed voltage is applied to the anode electrode and the cathode electrode of the light-emitting diode OLED so that the light-emitting diode OLED may be prevented from undesirably emitting light. In addition, the second control voltage CB may be changed from a turn-off level CBh to a turn-on level CB1.

Figure 4:
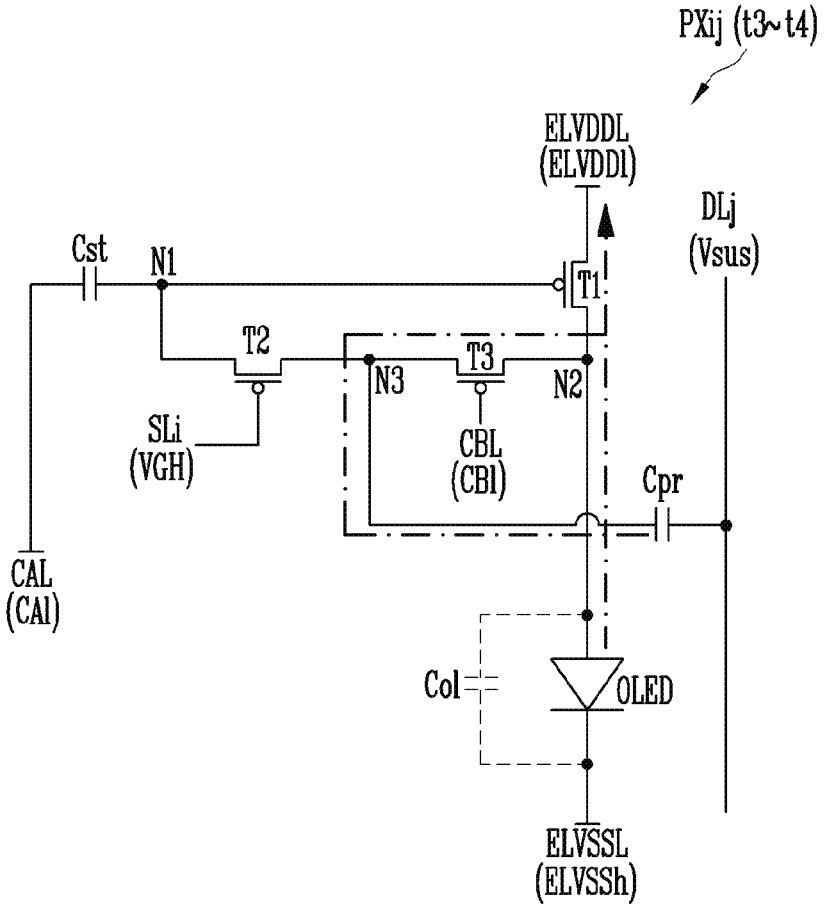
FIGS. 4 to 8 are circuit diagrams for describing the method of driving the display device according to the timing diagram of FIG. 3 in accordance with exemplary embodiments of the inventive concept.

At time t3, the first control voltage CA may be changed from a high level CAh to a low level CAL Referring to FIG. 4, as the first control voltage CA is reduced, the voltage of the first node N1, that is capacitively coupled with the first control line CAL by the first capacitor Cst, is also reduced. Therefore, the first transistor T1 is turned on. Thus, during a period t3 to t4, the first and third transistors T1 and T3 remain turned on, and the second and third nodes N2 and N3 are coupled with the first power supply voltage line ELVDDL. Hence, the capacitance Col of the light-emitting diode OLED and the second capacitor Cpr may be initialized to the first power supply voltage ELVDD of the low level ELVDDl.

A period t3 to t5 may be referred to as a first initialization period. The first initialization period may correspond to a first initialization operation of the driving method. The low level CA1 of the first control voltage CA applied to the first control line CAL during the first initialization period may be less than the high level CAh of the first control voltage CA in emission enable periods. The emission enable periods will be described below with reference to FIGS. 9 to 12.

At time t4, scan signals . . . , S(i−1), Si, S(i+1), . . . of a turn-on level VGL may be substantially simultaneously applied to the scan lines. Therefore, since the first to third nodes N1, N2, and N3 are coupled with one another, the first capacitor Cst may be additionally initialized. Here, the first transistor T1 may be diode-connected by the second and third transistors T2 and T3. In other words, during at least a portion (t4 to t5) of the first initialization period, the second control voltage CB applied to the second control line CBL may be at the turn-on level CB1, and the scan signal Si applied to the scan line SLi may be at the turn-on level VGL.

At time t5, the first control voltage CA may be changed from the low level CA1 to the high level CAh. In this case, although the voltage of the first node N1 is partially increased, a voltage increment of the first node N1 may be less than a difference between the low level CA1 and the high level CAh because the first node N1 is also coupled with the other capacitive elements Col and Cpr through the third node N3 and the second node N2.

Figure 5:
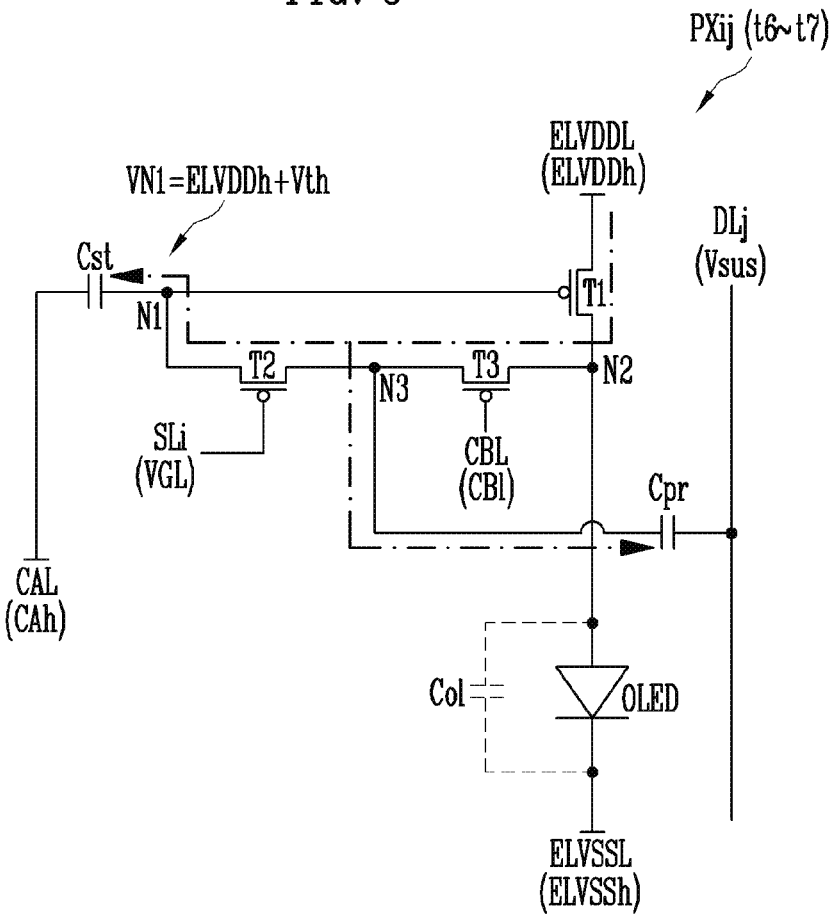

At time t6, the first power supply voltage ELVDD is increased from the low level ELVDDl to the high level ELVDDh. Referring to FIG. 5, since the first transistor T1 is in a diode-connected state, a voltage VN1 obtained by adding a threshold voltage Vth of the first transistor T1 to the first power supply voltage ELVDD of the high level ELVDDh may be applied to the first node N1. Here, since the threshold voltage Vth is a negative number, the first node voltage VN1 may be less than the first power supply voltage ELVDD of the high level ELVDDh. Therefore, during a period t6 to t7, a voltage corresponding to a difference between the first node voltage VN1 and the first control voltage CA having the high level CAh may be applied to the first capacitor Cst.

The period t6 to t7 may be referred to as a compensation period. The compensation period may correspond to a compensation operation of the driving method. During the compensation period, the second control voltage CB and the scan signal Si may be respectively at the turn-on levels CB1 and VGL. The high level ELVDDh of the first power supply voltage ELVDD of the compensation period may be greater than the low level ELVDDl of the first power supply voltage ELVDD of the first initialization period.

At time t7, the first power supply voltage ELVDD may be reduced from the high level ELVDDh to the low level ELVDDl, the second control voltage CB may be changed from the turn-on level CB1 to the turn-off level CBh, and the scan signals . . . , S(i−1), Si, S(i+1), . . . may be changed from the turn-on level VGL to a turn-off level VGH. Therefore, the second and third transistors T2 and T3 are turned off, so that the diode-connection of the first transistor T1 may be disconnected.

During a period t7 to t10, the scan signals . . . , S(i−1), Si, S(i+1), . . . having the turn-on level VGL may be sequentially applied to the scan lines SL1 to SLm. Furthermore, data voltages . . . , D(i−1)j, Dij, D(i+1)j, . . . synchronized with the scan signals . . . , S(i−1), Si, S(i+1), . . . may be sequentially applied to the data line DLj. The period t7 to t10 may be referred to as a data write period. The data write period may correspond to a data voltage write operation of the driving method. The data voltages . . . , D(i−1)j, Dij, D(i+1)j, . . . may be written to the first electrode of the second capacitor Cpr, which is coupled to the gate electrode of the first transistor T1 via the second transistor T2 and the first node N1.

For example, during a period t8 to t9, the scan signal Si having the turn-on level VGL may be applied to the scan line SLi, and the data voltage Dij may be applied to the data line DLj. During at least a portion (t8 to t9) of the data write period, the second control voltage CB may be at the turn-off level CBh, the scan signal Si may be at the turn-on level VGL, and the low level ELVDDl of the first power supply voltage ELVDD may be less than or equal to the high level ELVSSh of the second power supply voltage ELVSS.

Figure 6:
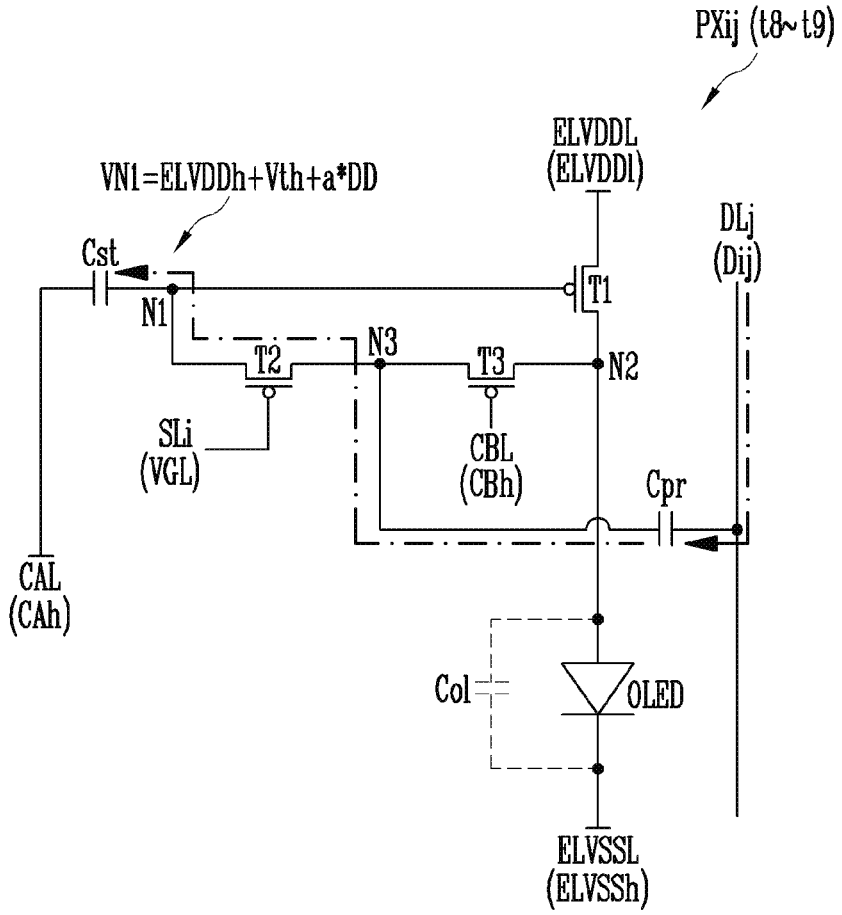

Referring to FIG. 6, the first node N1 may be coupled with the third node N3 through the turned-on second transistor T2, and the third node N3 may be capacitively coupled with the data line DLj through the second capacitor Cpr. Compared to the period t6 to t7 of FIG. 5 with respect to a path including the first control line CAL, the first capacitor Cst, the second transistor T2, the second capacitor Cpr, and the data line DLj, a reference voltage Vsus applied to the data line DLj during the period t8 to t9 of FIG. 6 may be changed to a data voltage Dij.

Therefore, compared to the period t6 to t7 of FIG. 5, the first node voltage VN1 may further reflect a difference voltage DD between the data voltage Dij and the reference voltage Vsus based on a capacitance ratio of the first capacitor Cst and the second capacitor Cpr (refer to the following Equations 1 to 3).

$$DD = Dij - Vsus \quad \text{[Equation 1]}$$

$$a = \frac{CprF}{CstF + CprF} \quad \text{[Equation 2]}$$

$$VN1 = ELVDDh + Vth + a * DD \quad \text{[Equation 3]}$$

Here, CstF is a capacitance of the first capacitor Cst, and CprF is a capacitance of the second capacitor Cpr.

Figure 7:
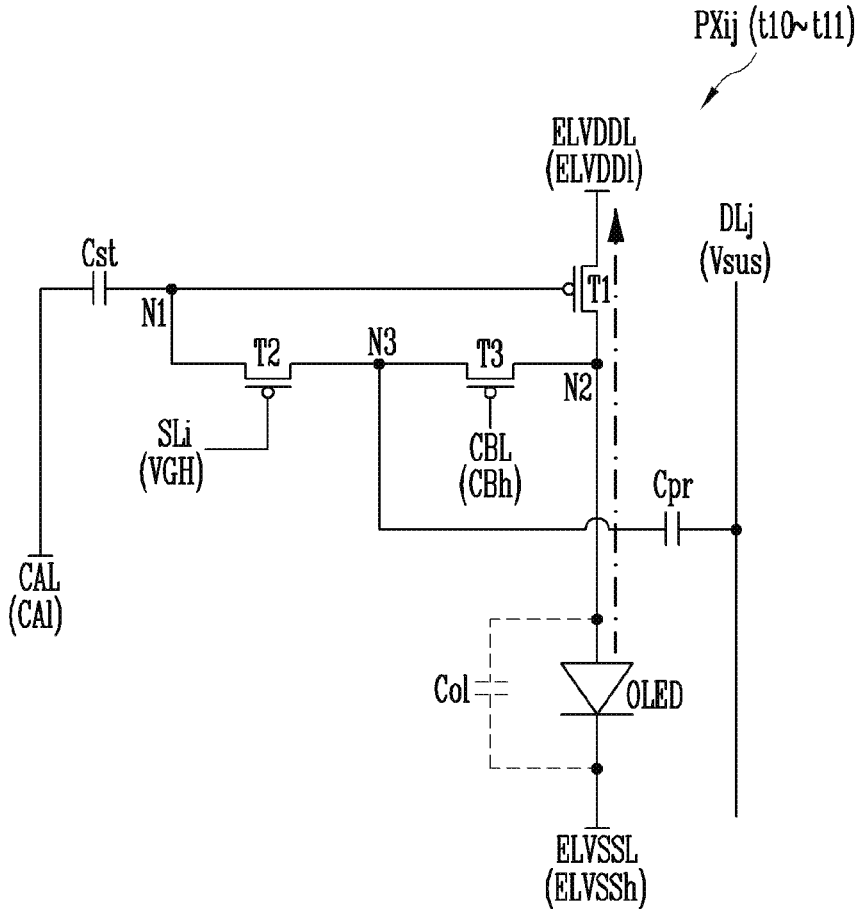
Figure 8:
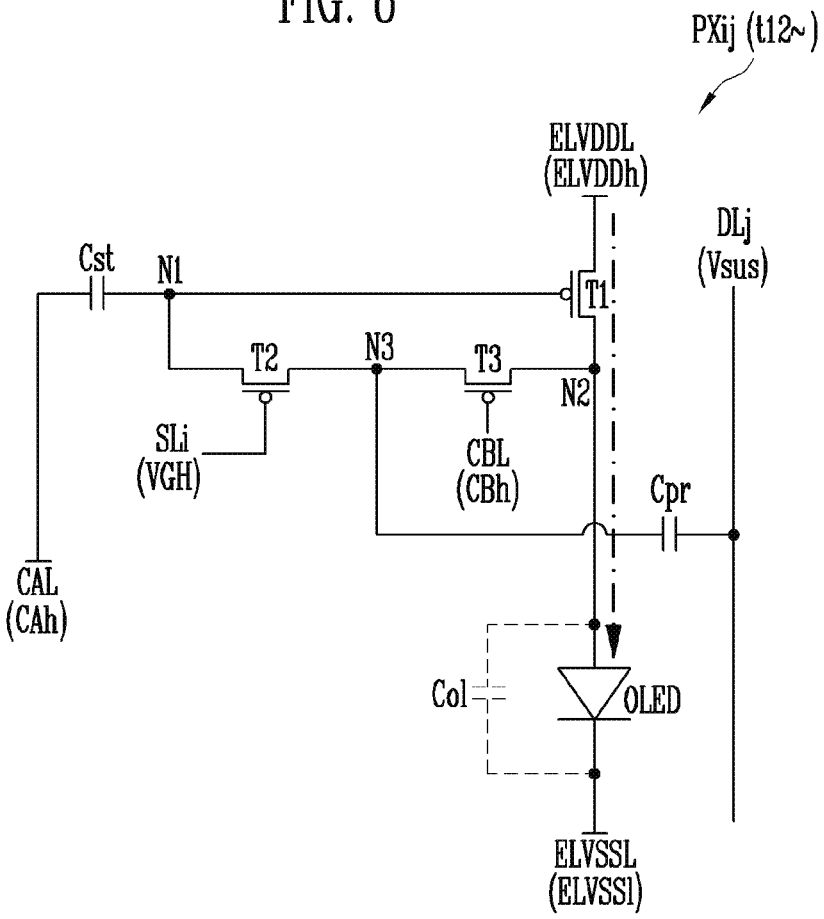

At time t10, the first control voltage CA may be changed from the high level CAh to the low level CA1. Referring to FIG. 7, as the voltage of the first node N1 that is capacitively coupled with the first control line CAL through the first capacitor Cst is reduced, the first transistor T1 may be turned on. Here, the first power supply voltage ELVDD may be at the low level ELVDDl, and the second power supply voltage ELVSSL may be at the high level ELVSSh. Hence, the light-emitting diode OLED may not emit light, and the capacitance Col of the light-emitting diode OLED may be initialized.

A period t10 to t11 may be referred to as a second initialization period. The second initialization period may correspond to a second initialization operation of the driving method. The low level CA1 of the first control voltage CA in the second initialization period may be less than the high level CAh of the first control voltage CA in the emission enable periods. In addition, the low level ELVDDl of the first power supply voltage ELVDD during the second initialization period may be less than or equal to the high level ELVSSh of the second power supply voltage ELVSS.

At time t11, as the first control voltage CA may be changed from the low level CA1 to the high level CAh, the second initialization period may be terminated.

At time t12, the first power supply voltage ELVDD may be changed from the low level ELVDDl to the high level ELVDDh, and the second power supply voltage ELVSS may be changed from the high level ELVSSh to the low level ELVSS1. Therefore, referring to FIG. 8, since forward voltage may be applied to the light-emitting diode OLED, the driving current path may be activated. Here, the amount of driving current flowing through the first transistor T1 may be determined, based on the voltage stored in the first capacitor Cst. The light-emitting diode OLED may emit light in proportion to the amount of driving current.

Figure 9:
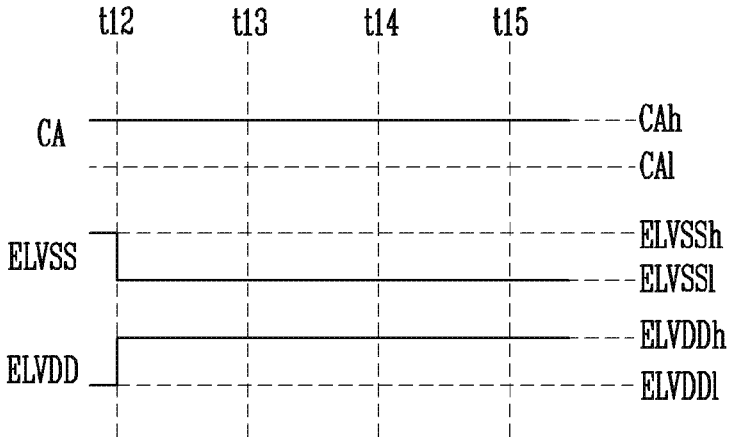
FIGS. 9-12 are timing diagrams for describing a method of driving the display device of FIG. 1 in accordance with exemplary embodiments of the inventive concept.

FIG. 9 is a timing diagram for describing a method of driving the display device of FIG. 1 in accordance with an exemplary embodiment of the inventive concept.

Referring to FIG. 9, during an image frame period, after time t12, the voltage levels of the first control voltage CA, the first power supply voltage ELVDD, and the second power supply voltage ELVSS may remain constant.

Therefore, according to the driving method of FIG. 9, after time t12, each image frame may include only one emission enable period without including an emission inhibit period.

In the following exemplary embodiments, descriptions of the amount of driving current will be provided, based on the amount of driving current in the exemplary embodiment of FIG. 9.

Figure 10:
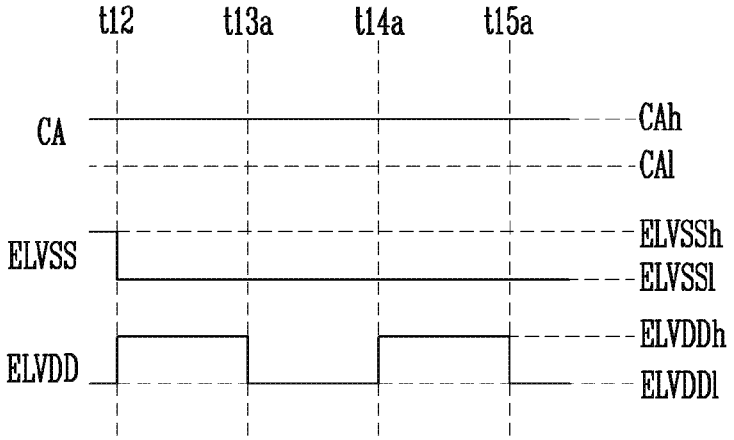
Figure 11:
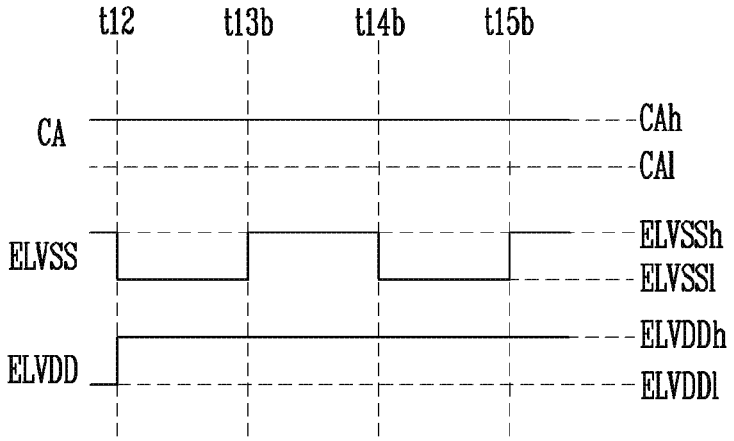
Figure 12:
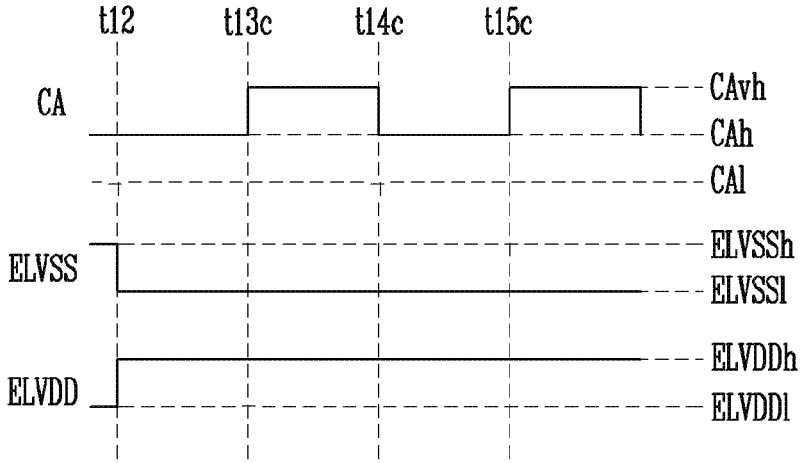

FIGS. 10-12 are timing diagrams illustrating a method of the display device of FIG. 1 where each of image frames includes at least two emission enable periods for the light-emitting diode, and at least one emission inhibit period between the at least two emission enable periods.

FIG. 10 is a timing diagram for describing a method of driving the display device of FIG. 1 in accordance with an exemplary embodiment of the inventive concept.

Referring to FIG. 10, each image frame of the display device 10 in accordance with an exemplary embodiment of the inventive concept may include at least two emission enable periods t12 to t13*a* and t14*a* to t15*a* for the light-emitting diode OLED, and at least one emission inhibit period t13*a* to t14*a* between the emission enable periods t12 to t13*a* and t14*a* to t15*a*.

The emission enable period t12 to t13*a* may correspond to a first emission enable operation of the driving method. The emission enable period t14*a* to t15*a* may correspond to a second emission enable operation of the driving method. The emission inhibit period t13*a* to t14*a* may correspond to an emission inhibit operation of the driving method. In the following exemplary embodiments, repetitive descriptions will be omitted.

In the exemplary embodiment of FIG. 10, the high level ELVDDh of the first power supply voltage ELVDD in the emission enable periods t12 to t13*a* and t14*a* to t15*a* may be greater than the low level ELVDDl of the first power supply voltage ELVDD in the emission inhibit period t13*a* to t14*a*.

The high level ELVDDh of the first power supply voltage ELVDD in the emission enable periods t12 to t13*a* and t14*a* to t15*a* may be greater than the low level ELVSS1 of the second power supply voltage ELVSS. Therefore, a forward voltage may be applied to the light-emitting diode OLED, and the light-emitting diode OLED may emit light according to the amount of driving current based on the amount of voltage stored in the first capacitor Cst.

The low level ELVDDl of the first power supply voltage ELVDD in the emission inhibit period t13*a* to t14*a* may be less than or equal to the low level ELVSS1 of the second power supply voltage ELVSS. Therefore, a reverse voltage may be applied to the light-emitting diode OLED, and the light-emitting diode OLED may not emit light regardless of the amount of voltage stored in the first capacitor Cst.

According to the exemplary embodiment of FIG. 10, each image frame includes the emission inhibit period t13*a* to t14*a*, unlike that of the exemplary embodiment of FIG. 9. Hence, compared to the exemplary embodiment of FIG. 9, a period during which the light-emitting diode OLED emits light is reduced. However, in the exemplary embodiments of FIGS. 9 and 10, the gradation in an image frame which is visible to the user may remain the same. Therefore, to achieve the same gradation, in the exemplary embodiment of FIG. 10, the amount of driving current in the emission enable periods t12 to t13*a* and t14*a* to t15*a* may be increased by reducing the size of the data voltage Dij applied to the data line DLj during the period t8 to t9 as compared to that of the exemplary embodiment of FIG. 9.

In other words, for the same gradation, the average amount of driving current during the emission enable periods t12 to t13*a* and t14*a* to t15*a* in the exemplary embodiment of FIG. 10 may be greater than the average amount of driving current during the emission enable period (t12~) in the exemplary embodiment of FIG. 9.

Therefore, the capacitance Col of the light-emitting diode OLED in the driving method of FIG. 10 may be more rapidly charged compared to that of the driving method of FIG. 9, and thus the incidence of defective display such as an emission delay may be reduced.

FIG. 11 is a timing diagram for describing a method of driving the display device of FIG. 1 in accordance with an exemplary embodiment of the inventive concept.

Referring to FIG. 11, each image frame of the display device 10 in accordance with an exemplary embodiment of the inventive concept may include at least two emission enable periods t12 to t13*b* and t14*b* to t15*b* for the light-emitting diode OLED, and at least one emission inhibit period t13*b* to t14*b* between the emission enable periods t12 to t13*b* and t14*b* to t15*b*.

In the exemplary embodiment of FIG. 11, the low level ELVSS1 of the second power supply voltage ELVSS in the emission enable periods t12 to t13*b* and t14*b* to t15*b* may be less than the high level ELVSSh of the second power supply voltage ELVSS in the emission inhibit period t13*b* to t14*b*.

The high level ELVDDh of the first power supply voltage ELVDD in the emission enable periods t12 to t13*b* and t14*b* to t15*b* may be greater than the low level ELVSS1 of the second power supply voltage ELVSS. Therefore, a forward voltage may be applied to the light-emitting diode OLED, and the light-emitting diode OLED may emit light according to the amount of driving current based on the amount of voltage stored in the first capacitor Cst.

The high level ELVSSh of the second power supply voltage ELVSS in the emission inhibit period t13*b* to t14*b* may be greater than or equal to the high level ELVDDh of the first power supply voltage ELVDD. Therefore, a reverse voltage may be applied to the light-emitting diode OLED, and the light-emitting diode OLED may not emit light regardless of the amount of voltage stored in the first capacitor Cst.

According to the exemplary embodiment of FIG. 11, each image frame includes the emission inhibit period t13*b* to t14*b*, unlike that of the exemplary embodiment of FIG. 9. Hence, compared to the exemplary embodiment of FIG. 9, a period during which the light-emitting diode OLED emits light is reduced.

Therefore, as explained in the description of the exemplary embodiment of FIG. 10, according to the driving method of the exemplary embodiment of FIG. 11, the amount of driving current may be increased with regard to the same gradation. Therefore, the capacitance Col of the light-emitting diode OLED in the driving method of FIG. 11 may be more rapidly charged compared to that of the driving method of FIG. 9, and thus the incidence of defective display such as an emission delay may be reduced.

In summary, in the above-described exemplary embodiments of FIGS. 10 and 11, during each of the at least two emission enable periods (e.g., t12 to t13*a/b* and t14*a/b* to t15*a/b*), a first power supply voltage (e.g., ELVDDh) applied to the first power supply voltage line ELVDD may be set to be greater than a second power supply voltage (e.g., ELVSS1) applied to the second power supply voltage line ELVSS. In the emission inhibit operation (t13*a/b* to t14*a/b*), the first power supply voltage (e.g., ELVDDl in FIG. 10 and ELVDDh in FIG. 11) applied to the first power supply voltage line ELVDD may be set to be less than or equal to the second power supply voltage (e.g., ELVSS1 in FIG. 10 and ELVSSh in FIG. 11) applied to the second power supply voltage line ELVSS.

In other words, in FIGS. 10 and 11, one of the first power voltage and the second power voltage is maintained at a relatively constant level during the first emission enable operation, the emission inhibit operation, and the second emission enable operation.

FIG. 12 is a timing diagram for describing a method of driving the display device of FIG. 1 in accordance with an exemplary embodiment of the inventive concept.

Referring to FIG. 12, each image frame of the display device 10 in accordance with an exemplary embodiment of the inventive concept may include at least two emission enable periods t12 to t13*c* and t14*c* to t15*c* for the light-emitting diode OLED, and at least one emission inhibit period t13*c* to t14*c* between the emission enable periods t12 to t13*c* and t14*c* to t15*c*.

The high level ELVDDh of the first power supply voltage ELVDD in the emission enable periods t12 to t13*c* and t14*c* to t15*c* and the emission inhibit period t13*c* to t14*c* of FIG. 12 may be greater than the low level ELVSS1 of the second power supply voltage ELVSS. Therefore, when the first transistor T1 is turned on, a forward voltage may be applied to the light-emitting diode OLED.

In the exemplary embodiment of FIG. 12, the high level CAh of the first control voltage CA in the emission enable periods t12 to t13*c* and t14*c* to t15*c* may be less than a voltage level CAvh of the first control voltage CA in the emission inhibit period t13*c* to t14*c*.

During the emission enable periods t12 to t13*c* and t14*c* to t15*c*, the voltage of the first node N1 may maintain the voltage of the above-described Equation 3 at the high level CAh of the first control voltage CA, whereby the first transistor T1 may be turned on. Hence, the light-emitting diode OLED may emit light according to the amount of driving current based on the amount of voltage stored in the first capacitor Cst.

During the emission inhibit period t13*c* to t14*c*, the voltage level CAvh of the first control voltage CA may be increased, compared to that of the emission enable periods t12 to t13*c* and t14*c* to t15*c*. Thus, the voltage of the first node N1 may be increased by capacitive coupling, and the first transistor T1 may be turned off. Hence, the light-emitting diode OLED may not emit light regardless of the amount of voltage stored in the first capacitor Cst.

According to the exemplary embodiment of FIG. 12, the first control voltage CA may have at least three voltage levels CA1, CAh, and CAvh. At the first initialization operation, the first control voltage CA having the low level Cal, less than the high level CAh of the first emission enable operation and the second emission enable operation, may be applied to the first control line CAL.

In other words, in the above-described exemplary embodiment of FIG. 12, in the first emission enable period (e.g., t12 to t13*c*), a first control voltage (e.g., CAh) may be applied to the first control line CA, and the first power supply voltage (e.g., ELVDDh) is set to be greater than the second power supply voltage (e.g., ELVSS1). In the emission inhibit operation (e.g., t13*c* to t14*c*), the first control voltage (e.g. CAvh) is set to be greater than the first control voltage (e.g., CAh) in the first emission enable operation. In the second emission enable operation (e.g., t14*c* to t15*c*), the first control voltage (e.g., CAh) is set to be less than the first control voltage (e.g., CAvh) in the emission inhibit operation, and the first power supply voltage (e.g., ELVDDh) is set to be greater than the second power supply voltage (e.g., ELVSS1).

According to the exemplary embodiment of FIG. 12, each image frame includes the emission inhibit period t13*c* to t14*c*, unlike that of the exemplary embodiment of FIG. 9. Hence, compared to the exemplary embodiment of FIG. 9, a period during which the light-emitting diode OLED emits light is reduced.

Therefore, as explained in the description of the exemplary embodiment of FIG. 10, according to the driving method of the exemplary embodiment of FIG. 12, the amount of driving current may be increased with regard to the same gradation. Therefore, the capacitance Col of the light-emitting diode OLED in the driving method of FIG. 12 may be more rapidly charged compared to that of the driving method of FIG. 9, and thus the incidence of defective display such as an emission delay may be reduced.

Referring to FIGS. 3 to 12, each image frame may sequentially include the first initialization period, the compensation period, the data write period, the second initialization period, and the emission enable periods. Furthermore, in terms of the driving method, the data voltage write operation, the first emission enable operation, the emission inhibit operation, and the second emission enable operation may be sequentially performed in each image frame. In more detail, the first initialization operation, the compensation operation, the data voltage write operation, the second initialization operation, the first emission enable operation, the emission inhibit operation, and the second emission enable operation may be sequentially performed in each image frame.

Various exemplary embodiments of the inventive concept may provide a display device and a method of driving the display device capable of securing a sufficient amount of driving current even if the display device has high resolution.

While the inventive concept has been shown and described with reference to exemplary embodiments thereof, it will be understood by those of ordinary skill in the art that various changes in form and details may be made thereto without departing from the spirit and scope of the inventive concept as set forth in the following claims.

What is claimed is:

1. A display device comprising pixels, wherein each of the pixels comprises:

a first transistor including a gate electrode coupled to a first node, a first electrode coupled to a first power supply voltage line, and a second electrode coupled to a second node; and a light-emitting diode including an anode electrode coupled to the second node, and a cathode electrode coupled to a second power supply voltage line, wherein each of image frames includes at least two emission enable periods for the light-emitting diode, and at least one emission inhibit period between the at least two emission enable periods, wherein, during each of the at least two emission enable periods, a first power supply voltage applied to the first power supply voltage line is greater than a second power supply voltage applied to the second power supply voltage line, and wherein, during a data voltage write operation and the at least one emission inhibit period, the first power supply voltage is less than or equal to the second power supply voltage.

2. The display device of claim 1, further comprising:

a second transistor including a gate electrode coupled to a scan line, a first electrode coupled to the first node, and a second electrode coupled to a third node;

a first capacitor including a first electrode coupled to the first node, and a second electrode coupled to a first control line;

a third transistor including a gate electrode coupled to a second control line, a first electrode coupled to the third node, and a second electrode coupled to the second node; and a second capacitor including a first electrode coupled to the third node, and a second electrode coupled to a data line.

3. The display device of claim 2, wherein a first control voltage applied to the first control line during each of the at least two emission enable periods is less than the first control voltage in the at least one emission inhibit period.

4. The display device of claim 2, wherein a first control voltage applied to the first control line during a first initialization period is less than the first control voltage in each of the at least two emission enable periods.

5. The display device of claim 4, wherein, during at least a portion of the first initialization period, a second control voltage applied to the second control line is at a turn-on level, and a scan signal applied to the scan line is at a turn-on level.

6. The display device of claim 5, wherein, during a compensation period, the second control voltage and the scan signal are at turn-on levels, and wherein the first power supply voltage applied to the first power supply voltage line in the compensation period is greater than the first power supply voltage applied to the first power supply voltage line in the first initialization period.

7. The display device of claim 6, wherein, during at least a portion of the first initialization period, the second control voltage is at a turn-off level, the scan signal is at the turn-on level, and the first power supply voltage is less than or equal to the second power supply voltage applied to the second power supply voltage line.

8. The display device of claim 7, wherein the first control voltage in a second initialization period is less than the first control voltage in each of the at least two emission enable periods, and wherein the first power supply voltage in the second initialization period is less than or equal to the second power supply voltage.

9. The display device of claim 8, wherein each of the image frames sequentially includes the first initialization period, the compensation period, a data write period, the second initialization period, and the at least two emission enable periods.

10. The display device of claim 1, wherein the first power supply voltage in each of the at least two emission enable periods is greater than the first power supply voltage in the at least one emission inhibit period.

11. The display device of claim 1, wherein the second power supply voltage in each of the at least two emission enable periods is less than the second power supply voltage in the at least one emission inhibit period.

12. A method of driving a display device comprising pixels, each of the pixels including a driving current path including a first power supply voltage line, a first electrode and a second electrode of a first transistor, an anode electrode and a cathode electrode of a light-emitting diode, and a second power supply voltage line, the method comprising:

writing, in a data voltage write operation, a data voltage to a first electrode of a first capacitor coupled to a gate electrode of the first transistor, wherein a first power supply voltage applied to the first power supply voltage line is less than or equal to a second power supply voltage applied to the second power supply voltage line;

setting, in a first emission enable operation of the light-emitting diode, the first power supply voltage to be greater than the second power supply voltage;

setting, in an emission inhibit operation of the light-emitting diode, the first power supply voltage to be less than or equal to the second power supply voltage; and setting, in a second emission enable operation of the light-emitting diode, the first power supply voltage to be greater than the second power supply voltage, wherein, in each of image frames, the data voltage write operation, the first emission enable operation, the emission inhibit operation, and the second emission enable operation are sequentially performed.

13. The method of claim 12, wherein the first power supply voltage in the first emission enable operation and the second emission enable operation is greater than the first power supply voltage in the emission inhibit operation.

14. The method of claim 12, wherein the second power supply voltage in the first emission enable operation and the second emission enable operation is less than the second power supply voltage in the emission inhibit operation.

15. The method of claim 12, further comprising:

applying, in a first initialization operation, a first control voltage to a first control line coupled to a second electrode of the first capacitor, wherein the first control voltage in the first initialization operation is less than the first control voltage in the first emission enable operation and the second emission enable operation.

16. The method of claim 15, further comprising:

diode-connecting, in a compensation operation, the first transistor, wherein the first power supply voltage in the compensation operation is greater than the first power supply voltage in the first initialization operation.

17. The method of claim 16, further comprising:

setting, in a second initialization operation, the first control voltage to be less than the first control voltage in the first emission enable operation and the second emission enable operation, wherein the first power supply voltage in the second initialization operation is less than or equal to the second power supply voltage.

18. The method of claim 17, wherein, in each of the image frames, the first initialization operation, the compensation operation, the data voltage write operation, the second initialization operation, the first emission enable operation, the emission inhibit operation, and the second emission enable operation are sequentially performed.

19. A method of driving a display device comprising pixels, each of the pixels including a driving current path including a first power supply voltage line, a first electrode and a second electrode of a first transistor, an anode electrode and a cathode electrode of a light-emitting diode, and a second power supply voltage line, the method comprising:

writing, in a data voltage write operation, a data voltage to a first electrode of a first capacitor coupled to a gate electrode of the first transistor, wherein a first power supply voltage applied to the first power supply voltage line is less than or equal to a second power supply voltage applied to the second power supply voltage line;

applying, in a first emission enable operation of the light-emitting diode, a first control voltage to a first control line coupled to a second electrode of the first capacitor, and setting the first power supply voltage to be greater than the second power supply voltage;

setting, in an emission inhibit operation of the light-emitting diode, the first control voltage to be greater than the first control voltage in the first emission enable operation; and setting, in a second emission enable operation of the light-emitting diode, the first control voltage to be less than the first control voltage of the emission inhibit operation, and the first power supply voltage to be greater than the second power supply voltage, wherein, in each of image frames, the data voltage write operation, the first emission enable operation, the emission inhibit operation, and the second emission enable operation are sequentially performed.

20. The method of claim 19, further comprising setting, in a first initialization operation, the first control voltage to be less than the first control voltage in the first emission enable operation and the second emission enable operation, and applying the first control voltage to the first control line.

21. A display device comprising pixels, wherein each of the pixels comprises:

a first transistor including a gate electrode coupled to a first node, a first electrode coupled to a first power supply voltage line, and a second electrode coupled to a second node;

a first capacitor including a first electrode coupled to the first node, and a second electrode coupled to a first control line; and a light-emitting diode including an anode electrode coupled to the second node, and a cathode electrode coupled to a second power supply voltage line, wherein, in each of image frames, a data voltage write operation, a first emission enable operation, an emission inhibit operation, and a second emission enable operation are sequentially performed, wherein, during at least the first emission enable operation and the second emission enable operation, a first control voltage is applied to the first control line to turn on the first transistor, wherein, during the first emission enable operation and the second emission enable operation, a first power supply voltage applied to the first power supply voltage line is greater than a second power supply voltage applied to the second power supply voltage line, and wherein, during the emission inhibit operation, the first power supply voltage is less than or equal to the second power supply voltage.

22. The display device of claim 21, wherein one of the first power voltage and the second power voltage is maintained at a constant level during the first emission enable operation, the emission inhibit operation, and the second emission enable operation.

23. The display device of claim 21, further comprising:

a second transistor including a gate electrode coupled to a scan line, a first electrode coupled to the first node, and a second electrode coupled to a third node;

a third transistor including a gate electrode coupled to a second control line, a first electrode coupled to the third node, and a second electrode coupled to the second node; and a second capacitor including a first electrode coupled to the third node, and a second electrode coupled to a data line.

* * * * *